US007685830B2

(12) United States Patent
Thybo et al.

(10) Patent No.: US 7,685,830 B2
(45) Date of Patent: Mar. 30, 2010

(54) METHOD FOR DETECTING CHANGES IN A FIRST MEDIA FLOW OF A HEAT OR COOLING MEDIUM IN A REFRIGERATION SYSTEM

(75) Inventors: Claus Thybo, Soenderborg (DK); Bjarne Dindler Rasmussen, Soenderborg (DK); Roozbeh Izadi-Zamanabad, Aalborg (DK)

(73) Assignee: Danfoss A/S, Nordborg (DK)

( * ) Notice: Subject to any disclaimer, the term of this patent is extended or adjusted under 35 U.S.C. 154(b) by 826 days.

(21) Appl. No.: 10/512,210

(22) PCT Filed: Apr. 12, 2003

(86) PCT No.: PCT/DK03/00251

§ 371 (c)(1),
(2), (4) Date: Apr. 11, 2005

(87) PCT Pub. No.: WO03/089854

PCT Pub. Date: Oct. 30, 2003

(65) Prior Publication Data

US 2005/0172647 A1 Aug. 11, 2005

(30) Foreign Application Priority Data

Apr. 22, 2002 (DE) ..... 102 17 975

(51) Int. Cl.
*F25B 49/00* (2006.01)
*F25D 17/00* (2006.01)
*F24F 11/04* (2006.01)

(52) U.S. Cl. ..... 62/126; 62/178; 165/244

(58) Field of Classification Search ..... 62/151, 62/178, 180, 272; 165/244, 246
See application file for complete search history.

(56) References Cited

U.S. PATENT DOCUMENTS

| | | | | |
|---|---|---|---|---|
| 2,295,992 | A | 9/1942 | Gonzalez et al. | |
| 3,171,462 | A | 3/1965 | Reinhart, Jr. | |
| 3,707,851 | A | 1/1973 | McAshan, Jr. | 62/125 |
| 3,918,300 | A | 11/1975 | Weisstuch et al. | |

(Continued)

FOREIGN PATENT DOCUMENTS

| | | | |
|---|---|---|---|
| CA | 2344908 | A1 | 1/2002 |

(Continued)

OTHER PUBLICATIONS

Yunus A Cengel, Michael A. Boles; Thermodynamics, 1998, Third Edition, pp. 214-217.*

(Continued)

*Primary Examiner*—Chen-Wen Jiang
(74) *Attorney, Agent, or Firm*—McCormick, Paulding & Huber LLP

(57) ABSTRACT

The invention concerns a method for detecting changes in a first flow of a heating or cooling medium in a refrigeration system whereby the first flow is conveyed through a heat exchanger wherein occurs heat transfer from the first flow to a second flow of a heating or cooling medium. The earliest possible detection of the changes is desired. For this it is provided that for the supervision of the first media flow moving through the heat exchanger a change in the enthalpy of the second media stream or a value derived therefrom is determined.

14 Claims, 3 Drawing Sheets

U.S. PATENT DOCUMENTS

| | | | | |
|---|---|---|---|---|
| 4,136,528 | A | 1/1979 | Vogel et al. | |
| 4,193,781 | A | 3/1980 | Vogel et al. | |
| 4,325,223 | A | 4/1982 | Cantley | 62/126 |
| 4,390,058 | A | 6/1983 | Otake et al. | 165/1 |
| 4,479,727 | A | 10/1984 | Domingorena et al. | 374/65 |
| 4,500,035 | A * | 2/1985 | Kuroda et al. | 236/92 B |
| 4,510,576 | A * | 4/1985 | MacArthur et al. | 702/182 |
| 4,574,870 | A | 3/1986 | Weitman | |
| 4,611,470 | A | 9/1986 | Enstrom | 62/127 |
| 4,614,087 | A | 9/1986 | Nadamoto et al. | |
| 4,621,502 | A | 11/1986 | Ibrahim et al. | 62/223 |
| 4,729,667 | A | 3/1988 | Blangetti et al. | |
| 4,766,553 | A | 8/1988 | Kaya et al. | 364/506 |
| 4,768,346 | A | 9/1988 | Mathur | 62/127 |
| 4,885,914 | A | 12/1989 | Pearman | 62/129 |
| 5,079,930 | A | 1/1992 | Beaverson et al. | |
| 5,289,692 | A | 3/1994 | Campbell et al. | 62/181 |
| 5,341,649 | A | 8/1994 | Nevitt et al. | |
| 5,363,905 | A | 11/1994 | Rhiel et al. | |
| 5,457,965 | A | 10/1995 | Blair et al. | |
| 5,596,507 | A * | 1/1997 | Jones et al. | 700/276 |
| 5,615,733 | A | 4/1997 | Yang | 165/11.1 |
| 5,623,426 | A | 4/1997 | Ozawa et al. | 364/557 |
| 5,689,963 | A | 11/1997 | Bahel et al. | 62/129 |
| 6,089,033 | A | 7/2000 | Dube | |
| 6,128,910 | A | 10/2000 | Faircloth | 62/129 |
| 6,223,544 | B1 | 5/2001 | Seem | 62/127 |
| 6,225,907 | B1 | 5/2001 | Derryberry et al. | 340/584 |
| 6,272,868 | B1 | 8/2001 | Grabon et al. | 62/125 |
| 6,330,802 | B1 | 12/2001 | Cummings et al. | |
| 6,460,358 | B1 | 10/2002 | Hebert | |
| 6,543,238 | B2 * | 4/2003 | Yamanaka et al. | 62/172 |
| 6,590,362 | B2 * | 7/2003 | Parlos et al. | 318/799 |
| 2002/0055358 | A1 * | 5/2002 | Hebert | 455/423 |
| 2002/0139128 | A1 | 10/2002 | Suzuki et al. | |
| 2003/0019221 | A1 * | 1/2003 | Rossi et al. | 62/127 |
| 2003/0055603 | A1 | 3/2003 | Rossi et al. | 702/185 |
| 2003/0156999 | A1 | 8/2003 | Knudsen et al. | |
| 2004/0144106 | A1 | 7/2004 | Douglas et al. | 62/127 |
| 2005/0166608 | A1 | 8/2005 | Thybo | 62/125 |
| 2005/0166609 | A1 | 8/2005 | Thybo et al. | 62/126 |
| 2006/0032606 | A1 | 2/2006 | Thybo et al. | 165/11.1 |

FOREIGN PATENT DOCUMENTS

| | | | |
|---|---|---|---|
| DE | 24 51 361 | | 5/1976 |
| EP | 0155826 | | 12/1990 |
| EP | 0 453 302 | A1 | 10/1991 |
| EP | 0 470 676 | A2 | 12/1992 |
| EP | 0 518 035 | B1 | 12/1992 |
| EP | 0 559 043 | | 4/1996 |
| GB | 2 062 919 | A | 5/1991 |
| JP | 01174870 | A2 | 12/1987 |
| JP | 63071625 | | 4/1988 |
| JP | 5264136 | | 10/1993 |
| JP | 07234043 | A2 | 2/1994 |
| JP | 2001255046 | | 9/2001 |
| WO | WO 87/05097 | | 8/1987 |
| WO | 02090832 | | 11/2002 |

OTHER PUBLICATIONS

Richard W. Hamming, Calculus and the Computer Revolution, 1968, The Mathematical Association of AMerica, Inc., pp. 43-57.

Wilbert F. Stoecker; Industrial Refrigeration Handbook; 1998; McGraw-Hill Companies, Inc.; pp. 55, 64-68.

Yunus A. Cengel; Michael A. Boles; Thermodynamics; Nov. 27, 2001; McGraw-Hill; 4th Edition; pp. 193-195.

International Search Report for Serial No. PCT/DK03/00252 dated Jul. 14, 2003.

International Search Report for Serial No. PCT/DK03/00468 dated Sep. 16, 2003.

International Search Report for Serial No. PCT/DK03/00701 dated Jan. 26, 2004.

European Search Report issued for related application No. 03 757 722.8 dated Sep. 22, 2005, 3 pages.

* cited by examiner

METHOD FOR DETECTING CHANGES IN A FIRST MEDIA FLOW OF A HEAT OR COOLING MEDIUM IN A REFRIGERATION SYSTEM

CROSS-REFERENCE TO RELATED APPLICATIONS

This application is entitled to the benefit of and incorporates by reference essential subject matter disclosed in International Patent Application No. PCT/DK03/00251 filed on Apr. 12, 2003 and German Patent Application No. 102 17 975.1 filed on Apr. 22, 2002.

FIELD OF THE INVENTION

The present invention concerns a method for detecting changes in a first media stream of a heating or cooling medium in a refrigeration system, in which the first media stream is moved through a heat exchanger, and in which occurs a heat transfer between the first media flow and a second media flow of a heating or cooling medium.

BACKGROUND OF THE INVENTION

U.S. Pat. No. 6,128,910 describes a method for diagnosing a refrigeration system for the cooling of air. In the method the physical values of the air, which pass through a heat exchanger of the system, are measured by a sensor arrangement (48), which is part of a measuring unit (44). The measured values are: air temperature, relative humidity of the air and volume flow of the air. By way of the air temperature and the relative humidity of the air an enthalpy change of the air by passage through the heat exchanger is determined. This change together with the volume flow is used to detect decreased air flow and lowered heat transfer, as well as lowered SHR. By way of additional measurements, the cooling medium temperature in the suction duct as well as the temperature of the liquid cooling medium between the condenser and the expansion valve, and the charging of the cooling medium can be investigated.

To explain the invention, in the following a sales cooling chest has been chosen as an example of the refrigeration system. The invention is, however, also useful in the case of other refrigeration systems. In the case of a sales cooling chest, such as for example used in supermarkets to hold cool or frozen products in ready condition for sale, an air flow which forms the first media flow is circulated in an air channel in which an evaporator is arranged. The evaporator is a heat exchanger on one side of which a cooling medium, comprising the second media flow, is moved in a liquid or two phase condition (gas and liquid). When the air is moved over the other side of the evaporator a heat transfer occurs from the air to the cooling medium and the air is cooled. Another example of a heat exchanger is the condenser over which the air is moved to liquefy the cooling medium. In this way heat is extracted from the cooling medium.

In the case of such a refrigeration system one wishes to be able to determine with a certain reliability whether the air stream can circulate in a sufficient mass; that is one wants to determine whether disturbances have appeared. Such disturbances can for example arise in that a fan has failed, in that the evaporator has iced up, in that dirt has accumulated in the air channel or that objects such as sales debris or goods have clogged the air channel and have increased the flow resistance for the air and have thereby hindered the air flow.

Such a fault recognition should most desirably take place before the cooling efficiency of the cooling system has been too strongly lessened. If a fault can first be recognized by an increase in temperature, it can be already too late for the cooled or frozen products; that is a risk exists that these products will have been spoiled. In many cases a disturbance of the air stream long before a damaging of the cooled products occurs means that the refrigeration system is not being operated at its optimum operating point. If therefore a fault has indeed occurred, individual components of the refrigeration system often become overloaded which reduces their service lifetime. This can be easily drawn from the example of fans. If one of several fans fails, the one or more remaining fans thereafter as before drive the necessary air flow through the refrigeration system to create the cooling efficiency. The remaining fans are, however, overloaded. Along with a lessening of the service life of the components, for example the fans, a fault has the disadvantage of an increased energy consumption. The refrigeration system becomes not operating at its optimum operating point. For this reason also the recognition of faults is important.

The invention has as its object the ability to recognize changes in the first media flow as early as possible.

SUMMARY OF THE INVENTION

This object in the case of a method of the initially mentioned kind is solved in that for monitoring the first media flow flowing through the heat exchanger one determines the change in the enthalpy of the second media flow or a value derived therefrom.

If the first media flow is formed by an air flow, the determination of the mass of the flowing air is relatively difficult to achieve by a measurement of the air flow itself. Such a measurement would moreover hinder the air flow, which would be undesirable. One chooses therefore another way: that is, one precedes from the fact that the air flow transports a certain amount of heat and therefore has a certain energy content. The energy content can also be designated as enthalpy. This heat in the heat exchanger is supplied to the cooling medium (or in the case of the condenser is supplied from the cooling medium). If now one can determine this amount of heat, then one has a statement to make about how much air is moved through the evaporator, that is the heat exchanger. This statement is sufficient to recognize whether a failure has appeared or not. The heat given off by the air per unit of time corresponds to the heat absorbed by the cooling medium per unit of time. This equilibrium is the basis of the method for detecting a lessened air flow in the channel. One can then compare this actual amount of air for example with a desired value. If this actual value does not agree with the desired value this is interpreted as a lessening of the air flow and can for example indicate a fault. This fault indication can take place in a relatively early phase, therefore long before a heavy overloading of the refrigeration system occurs or even before an undesired temperature increase takes place. The same procedure naturally serves also if instead of air another medium, for example a liquid or a brine, is used for the first media flow.

Preferably, one determines, for the detection of the change of the enthalpy of the second media flow, a mass flow and a specific enthalpy differential of the second media flow across the heat exchanger. The specific enthalpy of a cooling medium is a material and condition property and varies from cooling medium to cooling medium, or more generally, from second media flow to second media flow. The specific enthalpy is the enthalpy per unit or mass. Since, however, it is known what cooling medium is used, the specific enthalpy of the second media flow before and after the heat exchanger can be determined from measured values such as temperatures, pressures or the like. From this the specific enthalpy differential can be formed which in common with the mass flow permits a statement about the enthalpy.

In connection with this it is specially preferred that for the determination of the specific enthalpy differential of the second media flow the temperature and the pressure of the second media flow is determined at the input to the expansion valve and at the output of the heat exchanger the temperature of the second media flow and either the pressure at the output of the heat exchanger or the boiling temperature of the second media flow at the input of the heat exchanger is determined. The sensors for determining the temperature and the pressure of the second media flow, here the cooling medium, are in most cases already available. They are necessary to be able to appropriately control the cooling system. One can also measure the pressure of the cooling medium at the inlet and, it follows, the pressure at the outlet of the heat exchanger while one takes into consideration the pressure drop in the evaporator. From the measured or calculated values one can then, with the help of diagrams which the manufacturer of the cooling medium usually makes available for use (so called log p, h-diagrams), determine the specific enthalpies. In many cases, this can take place automatically, if the corresponding relationships are set out in tables or stand available by way of condition equations.

Preferably, one also determines a specific enthalpy differential of the first media flow across the heat exchanger. The specific enthalpy differential of the first media flow permits the mass per unit time of the first media flow, for example the air, to be calculated in a relatively simple way, as will be further shown below.

In a preferred way one determines the second media flow from a pressure differential across and the opening degree of an expansion valve. If a pulse width modulated expansion valve is in question, then the opening degree is replaced by the opening duration and the pulse duty factor. The mass flow of the second media flow, for example the cooling medium, is then proportional to the pressure differential and the opening duration. This allows the cooling medium flow to be determined in this way relatively easily. The subcooling of the cooling medium is above all in many cases so large that it is necessary to also measure the subcooling, because the cooling medium flow, that is the second media flow, through the expansion valve is influenced by the subcooling. In many other cases one need however only know the pressure differential and the opening degree of the valve, because the subcooling is a fixed value of the cooling system which then in a valve characteristic or by way of a proportionality constant can be taken into consideration. The term "opening degree" in the case of pulse width modulated valves can also be taken to mean the pulse duty factor.

In an alternative or additional development the second media flow is determined from operating data and the differential of the absolute pressure across the compressor together with the temperature of the second media flow at the compressor input. As to the operating data this means for example the rotational speed of the compressor, which together with the pressure across the compressor permits a statement about the amount of the cooling medium. In addition to this, it is only necessary to have knowledge of the compressor characteristics.

In a preferred way one determines the first media flow from the second media flow and a ratio of the specific enthalpy differential of the second media flow and a specific enthalpy differential of the first media flow across the heat exchanger.

As explained above, one precedes from the fact that between the quantity of heat which is transferred from the air to the cooling medium and the quantity of heat which is taken up by the air from the cooling medium a balance exists, that is both values substantially agree with one another. Simple expressed, the amount of heat of the air is the product of the mass flow of the air through the heat exchanger and the specific enthalpy different of the air across the heat exchanger. The heat amount of the cooling medium is the product of the cooling medium flow, that is the mass of the cooling medium per unit of time, through the heat exchanger and the specific enthalpy difference across the heat exchanger. By a simple rule of three then can the mass flow of the air (or more generally: of the first media flow, through the heat exchanger be determined.

In a preferred development it is provided that the first media flow is compared with a desired value. If the actual first media flow, that is as calculated from the above given values, does not agree with the desired value, a fault announcement can then be created.

Another alternative on the other hand is provided in that one forms a residual as the difference of a first value which is formed from a prescribed mass flow of the first media flow and the specific enthalpy differential, and of a second value which corresponds to the change in the enthalpy of the second media flow, and this residual is monitored. This procedure eases the evaluation of the determined signals. Because of the sluggishness of the individual sensors which determine the temperatures, the pressures and the mass flow it is possible that one can observe considerable fluctuations in the signal rendered by the first media flow, for example the air mass flow. These fluctuations, due to the "sluggishness" of the refrigeration system, have a relatively high frequency. It is therefore difficult with such a "high frequency" signal to recognize a trend which would indicate a fault. On the other hand if one obtains from the air mass signal a residual then the monitoring of the residual is essentially easier and permits an adequate monitoring of the air mass flow.

In this case it is especially preferred that as the prescribed mass flow of the first media flow one uses an average value over a predetermined time interval. One assumes that the mass flow is determined during a fault free operation. If then in operation deviations from this previously determined mass flow occurs and which are maintained over a predetermined short or long time interval, then this is taken as an indication of a fault.

Preferably with the help of the residual one forms a fault indicator $S_i$ according to the following formula:

$$S_i = \begin{cases} S_{i-1} + s_i, \text{ if } S_{i-1} + s_i > 0 \\ 0, \text{ if } S_{i-1} + s_i \leq 0 \end{cases}$$

where $s_i$ is calculated according to the following formula:

$$s_i = k_1\left(r_i - \frac{\mu_0 + \mu_1}{2}\right)$$

wherein i: index of a timewise sensing point $r_i$: residual $k_1$: proportionality constant $\mu_0$: first reliability value $\mu_1$: second reliability value.

The first reliability value is in most cases set to zero. The second reliability value $\mu_1$ forms a criteria for how often one must accept a false alarm. If one wishes to have fewer false alarms a later discovery of a fault has to be taken as the cost thereof. If the air circulation is lessened, because for example a fan no longer runs, then the fault indicator will become larger with time, because the periodic determination of the value of the residual $r_i$ on average becomes larger than zero. If the failure indicator $S_i$ has reached a preset value then an alarm is given which indicates that a fault has occurred. The second reliability value is an empirical value which usually will be pregiven by the manufacturer.

Preferably, one introduces a thawing procedure in the case of detecting a predetermined change. For example one can introduce the thawing process if the failure indicator reaches or exceeds a predetermined value. With these procedures thawing processes can be introduced when they are necessary even though the icing up of the evaporator as yet shows no negative effect.

BRIEF DESCRIPTION OF THE DRAWINGS

The invention is described in the following in more detail by way of a preferred embodiment in combination with the drawings. The drawings are:

Figure 1:
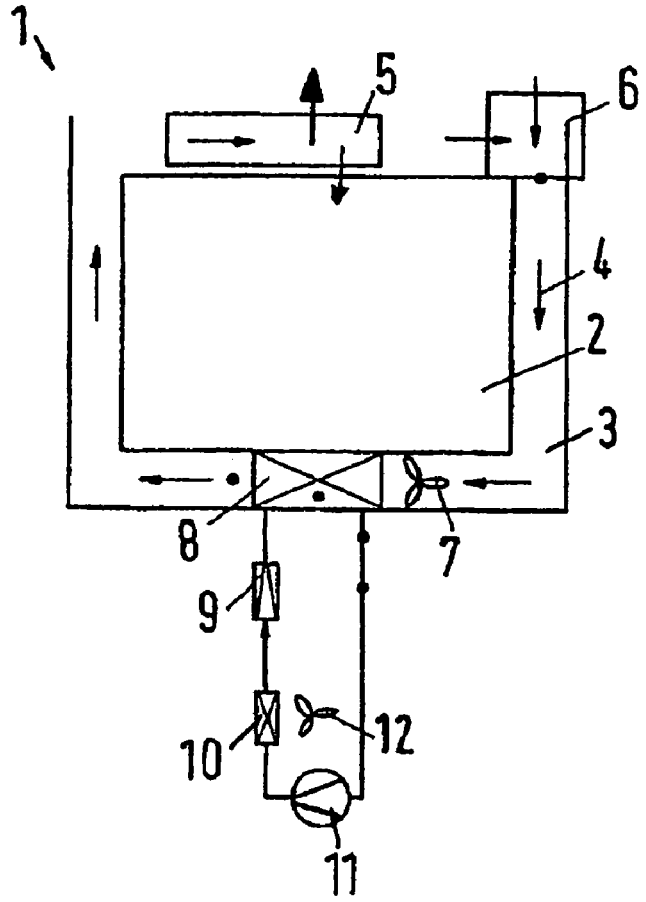
Figure 2:
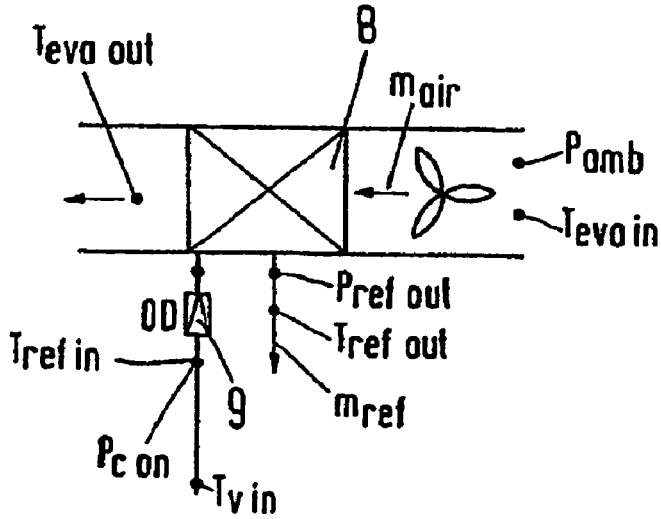
Figure 3:
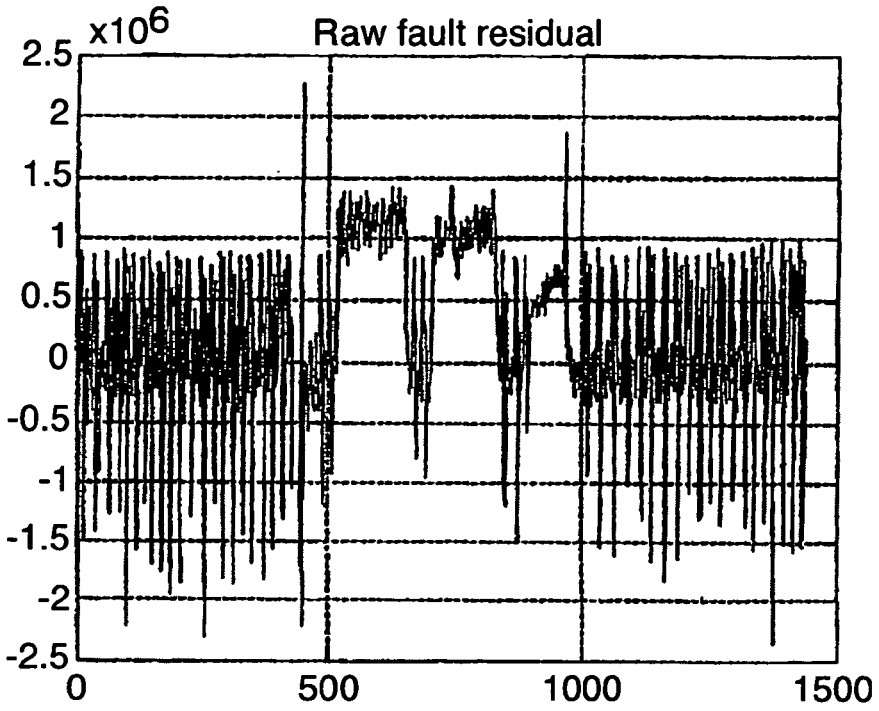
Figure 4:
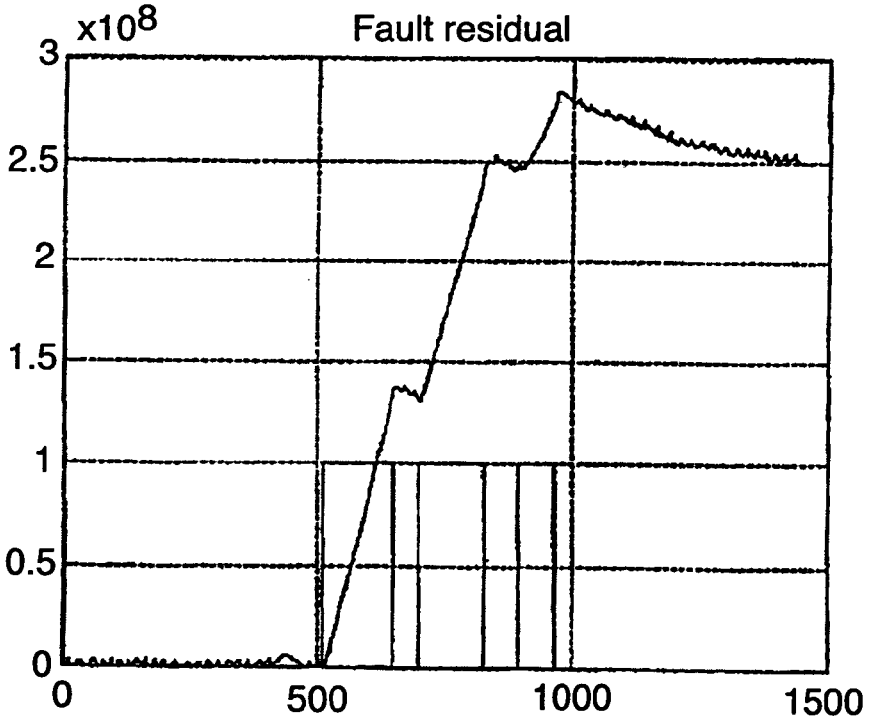
Figure 5:
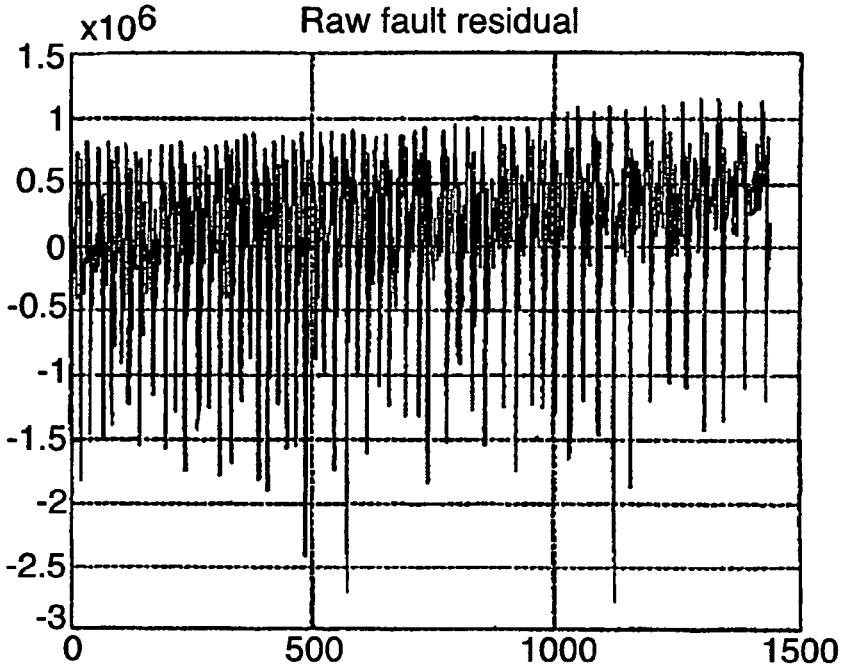
Figure 6:
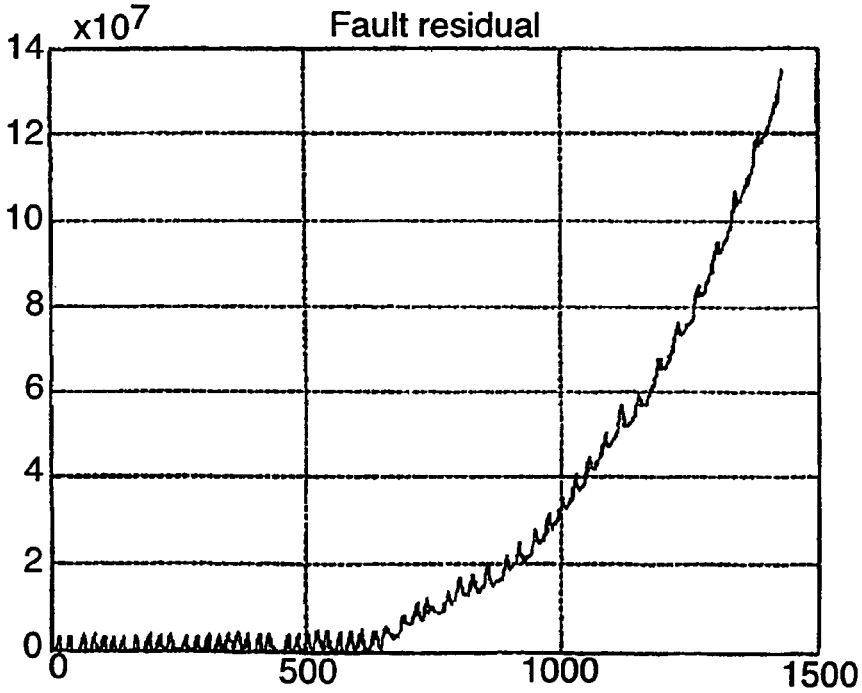

| | |
|---|---|
| FIG. 1 | is a schematic view of a refrigeration system, |
| FIG. 2 | is a schematic view with an illustration of values around a heat exchanger, |
| FIG. 3 | is an illustration of a residual in a first case of fault, |
| FIG. 4 | illustrates the course of a fault indicator for the first case of fault, |
| FIG. 5 | illustrates the course of the residual for a second case of fault, and |
| FIG. 6 | is an illustration of the fault indicator for the second case of fault. |

DETAILED DESCRIPTIN OF THE PREFERRED EMBODIMENTS

FIG. 1 shows schematically a refrigeration system 1 in the form of a low temperature sales chest, such as used for example in supermarkets for the sale of refrigerated or frozen foods. The refrigeration system 1 has a storage space 2, in which the foods are stored. An air channel 3 passes around the storage space 2, that is it is located along both sides and the bottom of the storage space 2. An air flow 4 which is indicated by the arrow, after passing through the air channel 3 moves into a cooling zone 5 located above the storage space 2. The air is then again delivered to the entrance of the air channel 3 at which is located a mixing zone 6. In the mixing zone the air stream 4 is mixed with ambient air. In this way compensation is made for the cooled air which moves into the storage space 2 or which otherwise disappears into the surroundings.

A blower arrangement 7 is arranged in the air channel 3, which arrangement can be formed by one or more fans. The blower arrangement 7 provides that the air flow 4 in the air channel 3 can be moved. For the purposes of the following description it will be assumed that the blower arrangement 7 so drives the air stream 4 that the mass of air which is moved through the air channel 3 per unit of time is constant, so long as the blower arrangement 7 is running and the system operates faultlessly.

In the air channel 3 is arranged an evaporator 8 having a cooling medium circuit. The evaporator 8 has delivered to it through an expansion valve 9 cooling medium from a condenser or liquifier 10. The condenser 10 is supplied by a compressor or densifier 11 whose input in turn is connected with the evaporator, 8 so that cooling medium is circulated in a known way. The condenser 10 is provided with a blower 12, with the help of a which air from the surroundings is blown over the condenser 10 remove heat from the condenser.

The operation of such a cooling medium circuit is known in itself. In the system a cooling medium is circulated. That cooling medium leaves the compressor 11 as a gas under high pressure and having a high temperature. In the condenser 10 the cooling medium is liquified with the giving off of heat. After the liquification the cooling medium passes through the expansion valve 9 where it is depressurized. After the depressurization the cooling medium has two phases, that is liquid and gas. This two phase cooling medium is delivered to the evaporator 8. The liquid phase there evaporates by taking on heat, with the heat being taken from the air stream 4. After the remaining cooling medium has been evaporated the cooling medium will have been slightly more heated and comes out of the evaporator 8 as overheated gas. Then it is delivered to the compressor 11 and is there compressed.

One must now observe whether the air stream 4 can pass undisturbedly through the air channel 3. Disturbances for example can arise because the blower arrangement 7 has a defect and no longer delivers sufficient air. For example, in the case of a blower unit with several fans one of the fans can fail. The remaining fans can then indeed deliver a certain amount of air through the air channel 3 so that the temperature in the storage space 10 does not rise above a permitted value. However, the refrigeration system becomes heavily loaded which can lead to later damage. For example, elements of the refrigeration system, such as fans, are often brought into operation. Another case of failure is for example the icing up of the evaporator by moisture from the ambient air which precipitates on the evaporator.

In other words, one therefore wants to be in the position of being able to permanently monitor the amount of air which flows through the air channel 3 per unit of time. Such monitoring can take place at timed intervals, that is at sequential points of time which for example have timewise spacings in the size order of a minute. Above all, the determination of the mass per time unit of the air stream 4 with normal measuring devices is relatively expensive. One uses therefore an indirect measurement, in that one determines the heat content of the cooling medium which is taken on by the cooling medium in the evaporator 8.

For this the following consideration is a basis: the heat needed to evaporate the cooling medium is in the evaporator 8, which acts as a heat exchanger, taken from the air. Accordingly, the following equation is valid:

$$\dot{Q}_{Air}=\dot{Q}_{Ref} \tag{1}$$

wherein $\dot{Q}_{Air}$ is the heat actually taken from the air per unit of time and $\dot{Q}_{Ref}$ is the heat absorbed by the cooling medium per unit of time. With this equation one can determine the actual value for the mass flow, that is the mass per unit of time, for the air flowing through the air channel 3, if one can determine the heat absorbed by the cooling medium. One can then compare the actual mass flow of the air with a desired value. If the actual value does not agree with the desired value, this is then interpreted as a fault, that is as an impaired air stream 4. A corresponding fault announcement for the system can then be given.

The basis for the determination of $\dot{Q}_{Ref}$ is the following equation:

$$\dot{Q}_{Ref}=\dot{m}_{Ref}(h_{Ref,out}-h_{Ref,in}) \tag{2}$$

wherein $\dot{m}_{Ref}$ is the cooling medium mass per unit of time which flows through the evaporator, $h_{Ref,out}$ is the specific enthalpy of the cooling medium at the evaporator outlet, and $h_{Ref,in}$ is the specific enthalpy at the expansion valve inlet.

A specific enthalpy of a cooling medium is a material and condition property, which varies from cooling medium to cooling medium, but which is determinable for each cooling medium. Cooling medium manufacturers therefore usually make available so called log p, h-diagrams for each cooling medium. Through the use of these diagrams a specific enthalpy differential across the evaporator 8 can be determined. To determine for example $h_{Ref,in}$ with such a log p, h-diagram, one needs only the temperature of the cooling medium at the expansion valve inlet ($T_{Ref,in}$) and the pressure at the expansion valve inlet ($P_{Con}$). These quantities can be measured with the help of a temperature sensor or pressure sensor. The measuring spots are schematically illustrated in FIG. 2.

To determine the specific enthalpy at the evaporator outlet one needs to measure two values: the temperature at the evaporator outlet ($T_{Ref,out}$) and either the pressure at the outlet ($P_{Ref,out}$) or the boiling temperature ($T_{Ref,in}$). The temperature at the outlet ($T_{Ref,out}$) can be measured with a temperature sensor. The pressure at the outlet of the evaporator 8 ($P_{Ref,out}$) can be measured by a pressure sensor.

Instead of the log p, h-diagram one can naturally also use tabulated values which simplify the calculation with the help of a computer. In many cases the cooling medium manufacturers also make available equations of state or condition for the cooling mediums.

The mass flow of the cooling medium ($\dot{m}_{Ref}$) can alternatively be determined by a flow meter. In the case of systems with electronically controlled expansion valves, which are driven with pulse width modulation, it is possible to determine the mass flow $\dot{m}_{Ref}$ from the degree of opening or the opening duration, if the pressure difference across the valve and the subcooling at the input to the expansion valve 9 ($T_{Vin}$) is known. In most systems this is the case, since pressure sensors are available for measuring the pressure in the condenser 10. The subcooling is in many cases constant and evaluatable, and therefore does not have to be measured. The mass flow $m_{Ref}$ through the expansion valve 9 can be calculated with the help of a valve characteristic, the pressure difference, the subcooling and the degree of opening or the opening duration. With many pulse width modulated expansion valve 9 it has been seen that the mass flow $m_{Ref}$ is nearly proportional to the pressure difference and to the opening duration. In this case one can determine the mass flow by the following equation:

$$\dot{m}_{Ref}=k_{Exp}\cdot(P_{Con}-P_{Ref,out})\cdot OD \tag{3}$$

wherein $P_{Con}$ is the pressure in the condenser 10, $P_{Ref,out}$ is the pressure in the evaporator, OD is the opening duration and $k_{Exp}$ is a proportionality constant dependent on the valve. In many cases the subcooling of the cooling medium is so large that it is necessary to measure the subcooling, because the cooling medium flow through the expansion valve is influenced by the subcooling. In many other cases, however, one needs only the pressure difference and the degree of opening of the valve because the subcooling is of a fixed size for the cooling system and can then be obtained from a valve characteristic or by a proportionality constant. Another possibility for determining the mass flow $\dot{m}_{Ref}$ exists in evaluating the values of the compressor 11, for example the rotational speed of the compressor, the pressures at the compressor inlet and outlet, the temperature at the compressor inlet, and a compressor characteristic.

For the actual value of the heat removed from the air per unit of time, $\dot{Q}_{Air}$, principally the same equation can be used as that for the heat per unit of time emitted by the cooling medium;

$$\dot{Q}_{Air}=\dot{m}_{Air}(h_{Air,in}-h_{Air,out}) \tag{4}$$

wherein $\dot{m}_{Air}$ is the mass flow of air, $h_{Air,in}$ is the specific enthalpy of the air in advance of the evaporator and $h_{Air,out}$ is the specific enthalpy of the air following the evaporator.

The specific enthalpy of the air can be calculated with the help of the following equation:

$$h_{Air}=1.006\cdot t+x(2501+1.8\cdot t),[h]=kJ/kg \tag{5}$$

where t is the temperature of the air, therefore $T_{Eva,in}$ for the air in advanced of the evaporator and $T_{Eva,out}$ for the air following the evaporator. "x" is used to indicate the proportion of moisture in the air. The proportion of moisture in the air can be calculated by the following equation:

$$x = 0.62198\cdot\frac{P_w}{P_{Amb}-P_w} \tag{6}$$

Here $P_w$ is the partial pressure of the water vapor in the air and $P_{Amb}$ is the pressure of the air. $P_{Amb}$ can either be measured or one can used for this value simply a standard atmospheric pressure. The deviation of the actual pressure from standard atmospheric pressure plays no significant role in the calculation of the amount of heat emitted from the air per unit of time. The partial pressure of the water vapor is determined by the relative humidity of the air and the partial pressure of the water vapor in saturated air and can be calculated from the following equation:

$$P_w=P_{w,Sat}\cdot RH \tag{7}$$

Here RH is the relative humidity of the air and $P_{w,Sat}$ is the partial pressure of the water vapor in saturated air. $P_{w,Sat}$ is dependent only on the air temperature and can be found in thermodynamic reference works. The relative humidity of the air RH can be measured or one can use typical values in the calculation.

If equations (2) and (4) are set equal to one another as in equation (1), the result is:

$$\dot{m}_{Ref}(h_{Ref,out}-h_{Ref,in})=\dot{m}_{Air}(h_{Air,in}-h_{Air,out}) \tag{8}$$

From this the actual air mass flow $\dot{m}_{Air}$ can be found, by separating out $\dot{m}_{Air}$ as follows:

$$\dot{m}_{Air} = \dot{m}_{Ref}\frac{(h_{Ref,out}-h_{Ref,in})}{(h_{Air,in}-h_{Air,out})} \tag{9}$$

This actual value for the air mass flow $\dot{m}_{Air}$ can then be compared with a desired value, and in the case of a substantial difference between the actual value and the desired value the operator of the refrigeration system can be made aware by way of a failure signal that the system is not running in an optimal manner.

In many cases it is recommendable that the desired value for the air flow in a system be determined. For example, this desired value can be determined as the average value over a given interval of time, during which the system runs under stable and fault free operating conditions. One such time interval can for example be 100 minutes.

A certain difficulty arises above all in that the signals produced by the individual sensors are subject to considerable fluctuations. These fluctuations can be quite opposite to one another so that for the value of $\dot{m}_{Air}$ a signal is obtained which poses certain difficulties for the evaluation. These fluctuations are a result of the dynamic relationships in the refrigeration system. Therefore, it can be beneficial, instead of the equation (9) in regularly spaced timed intervals, for example once per minute, to calculate a value which in the following is referred to as "residual":

$$r = \bar{\dot{m}}_{Air}(h_{Air,in} - h_{Air,out}) - \dot{m}_{Ref}(h_{Ref,out} - h_{Ref,in}) \tag{10}$$

$$\bar{\dot{m}}_{Air}$$

is an estimated value for the air mass flow under faultless operating conditions. Instead of an estimate one can also use a value which is determined as the middle value over a given time interval from equation (9).

In a system, which runs faultlessly, the residual should give an average value of zero, even though it is actually subject to considerable fluctuations. In order to be able to recognize early a fault indicated by a tendency of the residual, one assumes that the determined value for the residual is normally distributed about an average value and indeed is independent of whether the system operates faultlessly or whether a fault has appeared. One calculates then a fault indicator $S_i$ according to the following relationship:

$$S_i = \begin{cases} S_{i-1} + s_i, \text{ if } S_{i-1} + s_i > 0 \\ 0, \text{ if } S_{i-1} + s_i \leq 0 \end{cases} \tag{11}$$

where $S_i$ can be calculated by means of the following equation:

$$s_i = k_1\left(r_i - \frac{\mu_0 + \mu_1}{2}\right) \tag{12}$$

Here it is naturally assumed that the fault indicator $S_1$, that is for the first point of time, has been set to zero. For a later point of time one uses $s_i$ from equation (12) and forms the sum of this value with the fault indicator $S_i$ from an earlier point of time. If this sum is larger than zero, a fault indicator is reset to this new value. If this sum is equal to or smaller than zero the fault indicator is reset to zero. In equation (12) $k_1$ is a proportionality constant. $\mu_0$ can in the most simple case be set to the value zero. $\mu_1$ is an estimated value which for example can be derived in that one creates a fault and determines the average value of the residual with this fault. The value $\mu_1$ is a criterium for how often one has to accept a false alarm. The two μ-values are therefore also called reliability values.

When for example a fault occurs because a fan of the blower arrangement 7 does not run, then the fault indicator $S_i$ will become larger, because the periodically determined value of the residual $r_i$ on average becomes larger than zero. When the failure indicator reaches a predetermined value an alarm is activated which indicates that the air circulation has shrunken. If $\mu_1$ is made larger fewer fault alarms are made, however, also at the risk of a later discovery of a fault.

The mode of operation of the filtering according to equation (11) will now be explained in connection with FIGS. 3 and 4. In FIG. 3 time is represented to the right in minutes and the residual r is represented vertically. Between t=510 and t=644 minutes one fan of the blower arrangement 7 has failed. This makes itself felt by an increased value of the residual r. This increase is indeed already to be recognized in FIG. 3. A better recognition possibility exists, however, if one observes the failure indicator $S_i$, the course of which is illustrated in FIG. 4. Here the failure indicator $S_i$ is represented upwardly and the time t in minutes toward the right. The failure indicator therefore rises continuously in the time between t=510 minutes and t=644 minutes. One can, for example, upon the exceeding of the value $S_i$ of $0.2\times10^8$ activate an alarm.

In the time between t=700 and t=824 minutes is likewise a fan of the blower arrangement 7 shut down. The failure indicator $S_i$ increases further. Between these two disturbance happenings both fans are again active. The fault indicator $S_i$ is therefore lowered, but does not fall back to zero. The fault indicator $S_i$ is reliably increased in the case of failure. In the time from 0 to 510 minutes the fault indicator $S_i$ moves in the region of the zero point. The fault indicator $S_i$ would again move back to zero if the system were to run fault free for a long enough period of time. In practice one will of course set the failure indicator $S_i$ to zero when a failure has been corrected.

FIGS. 5 and 6 show the development of the residual r and the development of the fault indicator $S_i$ in the case were the evaporator 8 slowly ices up. Here in FIG. 5 the residual r and in FIG. 6 the fault indicator $S_i$ is represented upwardly, while the time t is represented to the right in minutes.

In FIG. 5 it is to be recognized that the middle value of the residual r gradually rises. It is especially to be likewise recognized that this increase as needed for a fault announcement of necessary reliability is to be obtained quantitatively only with difficulty. At t=600 minutes a beginning of an icing up of the evaporator 8 appears. First at t=1200 minutes can one detect such icing up by way of a reduced performance of the refrigeration system.

If for example one sets the boundary value for the fault indicator to $1\times10^7$, then a fault would be discovered already at about t=750 minutes, therefore essentially earlier, then by a reduced performance of the system.

The method can also be used to start a defrosting process. The defrosting process would then be started if the fault indicator $S_i$ reaches a predetermined value.

Advantageously, with this process an early discovery of failures, without using more sensors than in a typical system, is available. The faults are discovered before they create high temperature in the refrigeration system. Also, faults are discovered before the system no longer runs optimally, if one takes the required energy as the measure of it.

Illustrated is the control of the air flow at the evaporator 8. Obviously, one can carry out a similar control at the condenser 10. In this case the calculations are even simpler, because no moisture is taken from the ambient air when the air passes through the condenser 10. Accordingly, no water condenses from the air at the condenser 10, because this is warmer. A disadvantage in the case of using the method at the condenser 10 is that two additional temperature sensors are necessary for measuring the temperature of the air in front of and behind the condenser.

The method described has been for the case where the air flow is constant and adaption to different refrigeration requirements is achieved in that the air flow is intermittently created. It is, however, in principal also possible, within certain limits to permit a variation of the air stream, if one additionally makes reference to the driving power or to the rotational speed of the blower.

The method for detecting changes in the first media flow can also be used in the case of systems which operate with an indirect cooling. In the case of such systems one has a primary media flow, in which the cooling medium is circulated, and a secondary media flow, wherein a cooling agent, for example brine, circulates. In the evaporator the first media flow cools the second media flow. The second media flow then cools for example the air in a heat exchanger. One can not only use this method at the evaporator but also at the air/cooling agent heat exchanger. At the air side of the heat exchanger the calculations do not change. The enthalpy increase can, if the cooling agent is not subjected to an evaporation process in the heat exchanger but only to a temperature increase, be calculated with the following formula:

$$Q_{KT}=c\cdot m_{KT}(T_{after}-T_{before}) \tag{13}$$

wherein c is the specific heat capacity of the brine $T_{after}$ is the temperature behind the heat exchanger, $T_{before}$ is the temperature in front of the heat exchanger, and $m_{KT}$ is the mass flow of the cooling agent. The constant c can be found in reference works, while the two temperatures can be measured, for example, with temperature sensors. The mass flow $m_{KT}$ can be determined by a mass flow measurer. Other possibilities are naturally also imaginable. $Q_{KT}$ then replaces the calculation $Q_{Ref}$ in the further calculations.

What is claimed is:

1. A method for correcting a first media flow of a heat or coldness transport medium in a refrigeration system, the method comprising the steps of:

causing the first media flow to move through a heat exchanger in which a heat transfer between the first media flow and a second media flow of a heating or cooling agent occurs;

determining the second media flow as a linear function proportional to a pressure differential across and the opening degree of an expansion valve;

determining the change in the enthalpy of the second media flow or a value derived therefrom;

determining a change in the first media flow from the change in the enthalpy of the second media flow or from the value derived therefrom; and correcting the first media flow flowing through the heat exchanger, based on the determined change in the first media flow.

2. The method according to claim 1, wherein for the determination of the change in the enthalpy of the second media flow, a specific enthalpy differential of the second media flow across the heat exchanger is determined.

3. The method according to claim 2, wherein for the determination of the specific enthalpy change of the second media flow, at the input of the expansion valve the temperature and the pressure of the second media flow is determined and the temperature of the second media flow at the output of the heat exchanger and either the pressure at the output of the heat exchanger or the boiling temperature of the second media flow at the input of the heat exchanger are determined.

4. The method according to claim 2, wherein for the determination of the specific enthalpy change of the second media flow, the pressure of the second media flow at the input of the expansion valve is determined and the temperature of the second media flow at the output of the heat exchanger and either the pressure at the output of the heat exchanger or the boiling temperature of the second media flow at the input of the heat exchanger are determined.

5. The method according to claim 4, wherein the first media flow is determined from the second media flow and a ratio of the specific enthalpy change of the second media flow and the specific enthalpy change of the first media flow across the heat exchanger.

6. The method according to claim 4, wherein the first media flow is compared with a desired value.

7. The method according to claim 4, wherein a residual is formed as the difference between a first value, which is formed from a first pregiven mass flow of the first media flow and the specific enthalpy change of the first media flow, and a second value which corresponds to the change in the enthalpy of the second media flow, and determining the change in the first media flow includes monitoring the residual.

8. The method according to claim 7, wherein for the pregiven mass flow of the first media flow one uses an average value over a predetermined time interval.

9. The method according to claim 1, wherein a specific enthalpy change of the first media flow across the heat exchanger is determined.

10. The method according to claim 1, wherein correcting the first media flow includes the introduction of a thawing process.

11. A method for correcting a first media flow of a heat or coldness transport medium in a refrigeration system, the method comprising the steps of:

causing the first media flow to move through a heat exchanger in which a heat transfer between the first media flow and a second media flow of a heating or cooling agent occurs;

determining the second media flow from a pressure differential across and the opening degree of an expansion valve;

determining the change in the enthalpy of the second media flow or a value derived therefrom;

determining a change in the first media flow from the change in the enthalpy of the second media flow or from the value derived therefrom; and correcting the first media flow flowing through the heat exchanger, based on the determined change in the first media flow, wherein a residual is formed as the difference between a first value, which is formed from a first pregiven mass flow of the first media flow and the specific enthalpy change of the first media flow, and a second value which corresponds to the change in the enthalpy of the second media flow, and wherein a fault indicator $S_i$ is formed according to the following rule:

$$S_i=\begin{cases} S_{i-1}+s_i, \text{ if } S_{i-1}+s_i>0 \\ 0, \text{ if } S_{i-1}+s_i\le 0 \end{cases}$$

with $$s_i=k_1\left(r_i-\frac{\mu_0+\mu_1}{2}\right)$$

where $r_i$: residual $k_i$: proportionality constant $\mu_0$: first reliability value $\mu_1$: second reliability value, such that the first media flow is corrected based on the fault indicator exceeding a predetermined value.

12. A computer-implemented method for detecting changes in a flow of air in a refrigeration system, the method comprising the steps of:

causing the flow of air to move through a heat exchanger in which a heat transfer between the air and a flow of refrigerant occurs;

determining the flow of refrigerant as a linear function of a pressure differential across an expansion valve and the degree or period of opening of the expansion valve;

determining a change in the enthalpy of the flow of refrigerant or a value derived therefrom; and determining a change in the flow of air flowing through the heat exchanger from the change in the enthalpy of the flow of refrigerant or from the value derived therefrom, wherein for the determination of the change in the enthalpy of the refrigerant, the pressure of the refrigerant at the input of an expansion valve is determined and the temperature of the refrigerant at the output of the heat exchanger and either the pressure at the output of the heat exchanger or the boiling temperature of the refrigerant at the input of the heat exchanger are determined.

13. The method according to claim 12, comprising the additional step of:

initiating a thawing process if a predetermined change is determined in the flow of air.

14. A method for detecting and correcting changes in a flow of air in a refrigeration system, the method comprising the steps of:

causing the flow of air to move through a heat exchanger in which a heat transfer between the flow of air and a flow of refrigerant occurs;

determining a change in the specific enthalpy of the flow of refrigerant;

determining a rate of the flow of refrigerant from an opening degree of an expansion valve and a pressure differential across the expansion valve;

calculating a residual as the difference between a first value, which is calculated from a desired rate of the flow of air and a measured change across the heat exchanger of the specific enthalpy of the flow of air, and a second value which is calculated from the change in the specific enthalpy of the flow of refrigerant and the rate of the flow of refrigerant;

forming a fault indicator Si according to the following rule:

$$S_i = \begin{cases} S_{i-1} + s_i, \text{ if } S_{i-1} + s_i > 0 \\ 0, \text{ if } S_{i-1} + s_i \leq 0 \end{cases}$$

with $$s_i = k_1\left(r_i - \frac{\mu_0 + \mu_1}{2}\right)$$

where $r_i$: residual $k_i$: proportionality constant $\mu_0$: first reliability value $\mu_1$: second reliability value; and initiating a thawing process when $S_i$ exceeds a predetermined value.

* * * * *